US006368241B1

(12) United States Patent
Abel

(10) Patent No.: US 6,368,241 B1
(45) **Date of Patent: *Apr. 9, 2002**

(54) WRIST TOY

(76) Inventor: Jeffrey T. Abel, 116 Westview Ct., Evanston, WY (US) 82930

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/699,152

(22) Filed: Aug. 16, 1996

(51) Int. Cl.[7] ..... A63B 43/00
(52) U.S. Cl. ..... 473/508; 473/576
(58) Field of Search ..... 273/58 C, 414; 473/506, 508, 576, FOR 160, FOR 197, FOR 199

(56) References Cited

U.S. PATENT DOCUMENTS

| | | | | | |
|---|---|---|---|---|---|
| 667,563 | A | * | 2/1901 | Oakley | 273/58 C |
| 729,473 | A | * | 5/1903 | Wilson | 273/58 C |
| 795,960 | A | * | 8/1905 | Cook | 273/58 C |
| 1,782,254 | A | * | 11/1930 | Breidenbach | 273/414 |
| 2,142,068 | A | | 12/1938 | Berger | 273/97 |
| 2,269,633 | A | | 1/1942 | Merle | 273/97 |
| 3,031,191 | A | | 4/1962 | Bonang | 273/95 |
| 3,531,115 | A | * | 9/1970 | Alexander | 273/58 C |
| 3,635,476 | A | | 1/1972 | Breslow | 273/95 |
| 3,731,927 | A | | 5/1973 | Rocco, Jr. | 273/26 E |
| 3,785,643 | A | * | 1/1974 | Rich | 273/58 C |
| 3,843,126 | A | | 10/1974 | Bandy | 273/95 |
| 3,940,133 | A | * | 2/1976 | Civita | 273/58 C |
| 4,042,241 | A | | 8/1977 | Collins | 273/95 A |
| 4,121,822 | A | * | 10/1978 | DiSabatino et al. | 273/58 C |
| 4,147,353 | A | | 4/1979 | Moore | 273/95 |
| 4,272,076 | A | * | 6/1981 | Song et al. | 273/58 C |
| 4,346,902 | A | | 8/1982 | Warehime | 273/411 |
| 4,601,474 | A | | 7/1986 | Lew et al. | 273/414 |
| 4,687,209 | A | * | 8/1987 | Carey | 273/414 |
| 4,753,442 | A | | 6/1988 | Bland | 273/414 |
| 4,836,554 | A | | 6/1989 | Robbins | 273/321 |
| 4,836,555 | A | | 6/1989 | Wexler | 273/330 |
| 5,083,797 | A | | 1/1992 | Vartija et al. | 273/414 |
| 5,094,462 | A | | 3/1992 | Boyle et al. | 273/414 |
| 5,181,726 | A | | 1/1993 | Piaget | 273/414 |
| 5,401,034 | A | | 3/1995 | Mallinger | 273/414 |
| 5,443,576 | A | | 8/1995 | Hauter | 273/58 C |
| 5,544,894 | A | * | 8/1996 | Howard | 473/576 |
| 5,586,760 | A | | 12/1996 | Hauter | 273/58 C |

FOREIGN PATENT DOCUMENTS

| | | | | |
|---|---|---|---|---|
| GB | 2263408 | * | 7/1993 | 273/58 C |

* cited by examiner

*Primary Examiner*—John A. Ricci
(74) *Attorney, Agent, or Firm*—Fish & Richardson P.C.

(57) ABSTRACT

The present invention is directed to a new wrist toy. The wrist toy comprises a novel wrist band, elastic cord and ball construction. The wrist band of the present invention uniquely provides means for minimizing twisting and knotting of the elastic band located at the base of the palm of the user. The construction of the elastic cord and ball provides means for minimizing the degrading and wear contact of elastic cord with surfaces struck by the ball.

17 Claims, 2 Drawing Sheets

WRIST TOY

BACKGROUND OF THE INVENTION

1. The Field of the Invention

The apparatus of the present invention is a toy. In particular, a toy employing an elastic cord configured to minimize contact and abrasion of the elastic cord with the intended surface and employing means for preventing the elastic cord from knotting or twisting.

2. The Relevant Technology

Several tethered balls and recreational devices exist. U.S. Pat. No. 3,940,133 teaches an elastic cord attached to ball using an embedded socket member in one end of the ball. The attachment to the ball employs a pivot mount. U.S. Pat. No. 5,094,462 teaches a tethered soccer ball. A net is employed to surround the ball and to which an elastic cord is secured.

U.S. Pat. No. 3,843,126 teaches a tethered ball. An elastic band is attached at one end to a ball and on the other end to a flattened portion of a glove covering the palm and the back of the hand.

U.S. Pat. No. 4,836,555 teaches a combination glove and slap ball. A rubber band is attached at one end to a ball and to the other end to a disk anchor removably disposed in the glove.

U.S. Pat. Nos. 2,269,633 and 2,142,068 teach a toy. The toy employs an elastic strand attached at one end to a ball and attached at the other end to a disc or plate. A stirrup secured to the disc or plate is configured to receive the hand of the user.

U.S. Pat. No. 3,031,191 teaches a tethered ball game. A rubber band is secured at one end to a ball and is secured at the other end to a handle gripped by the user.

U.S. Pat. No. 3,635,476 teaches a pivotable target and ballstriking means. The ballstriking means comprises a ball which is connected to an elastic strand. The elastic strand is connected to a ringlike hand-clasping member.

U.S. Pat. No. 4,147,353 teaches a soccer ball retriever. The retriever includes an anchor stake, a cord and a ball holder. The cord comprises an elastic member and a braided nylon member. The cord is disposed between the ball holder and the anchor. A hook and swivel connect the cord to the anchor stake.

U.S. Pat. No. 4,601,474 teaches a self-retrieving attack ball. A spool rotatable about a shaft is disposed with the ball. Two spiral springs act against the spool. A cord is wound about the spool such that when the ball is thrown and the free end of the cord is retained, the cord unwinds from the spool, when the momentum of the ball no longer overcomes the spiral springs, or when the ball strikes an object, the spiral springs recoil the spool winding the cord up inside the ball.

U.S. Pat. No. 5,083,797 teaches a game ball training apparatus/carrier. The apparatus include a handle, an inelastic cord and an inelastic ball net. The inelastic cord is fastened at one end to the handle and the other end is looped through the net.

What is needed is a simplified construction of a wrist toy with a retrievable ball to develop eye-hand coordination. What is needed is a construction which minimizes the size and weight of the elastic cord member without sacrificing length to permit the ball to be thrown and to rebound with minimal interference from the elastic cord. What is also needed is an apparatus whose structural configuration minimizes the wear of the elastic cord while providing direct attachment of elastic members to the ball. It would also be desired to provide means for preventing the entire length of the elastic from twisting thereby avoiding knotting.

SUMMARY AND OBJECTS OF THE INVENTION

The present invention is directed to a novel retrievable toy. The ball can be thrown against walls or floors or simply to a distance until the length of the elastic cord causes the ball to rebound. The toy is directed to development of eye-hand coordination. That is, the present invention is directed to a toy which is preferably thrown and caught by the same hand.

In order to provide structure to facilitate eye-hand coordination, the materials of construction, the size of the ball and component parts, the interrelation and position of the component parts, and the location of the component parts vis-a-vis the hand are important features of the present invention The present invention is directed to minimizing interference caused by the cord when the ball is thrown and during the rebound travel of the ball. Because the ball of the present invention can and does strike wall and/or floors, it is also important to provide a construction which will minimize degrading wear of the elastic cord. All these objectives are met by the present invention.

The present invention is directed to a wrist toy comprising a wrist band, an elastic cord member and a ball. The elastic cord member is attached directly to the ball employing means for minimizing contact of the elastic cord with the floor or wall. The wrist band comprises a webbed band secured about the limb of the user. The wrist band is provided with means for receiving the elastic member and for avoiding or minimizing the twisting or knotting of the entire length of the elastic cord and ball.

In a preferred embodiment, the means for minimizing contact of the elastic cord with the floor or wall is accomplished by passing the elastic member directly through only a portion of the ball, not necessarily through the center or along a central axis of the ball. A preferred structure of the means to avoid or minimize the twisting or knotting of the entire length of the elastic cord and ball employs a freely rotating swivel releasably connected to the wrist band. A novel feature of the present invention is the position of the freely rotating swivel located on the wrist of the user so as to be at the base of the hand of the user.

An advantage and object of the present invention over the cited prior art is that the rebounding of the ball is directed to the hand of the user while avoiding or minimizing the twisting or knotting of the entire length of the elastic member.

Another object of the present invention includes minimizing the degrading or wear contact of the apparatus with the floor or wall.

Still another object of the present invention is to minimize interference of the flight or rebounding of the ball.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
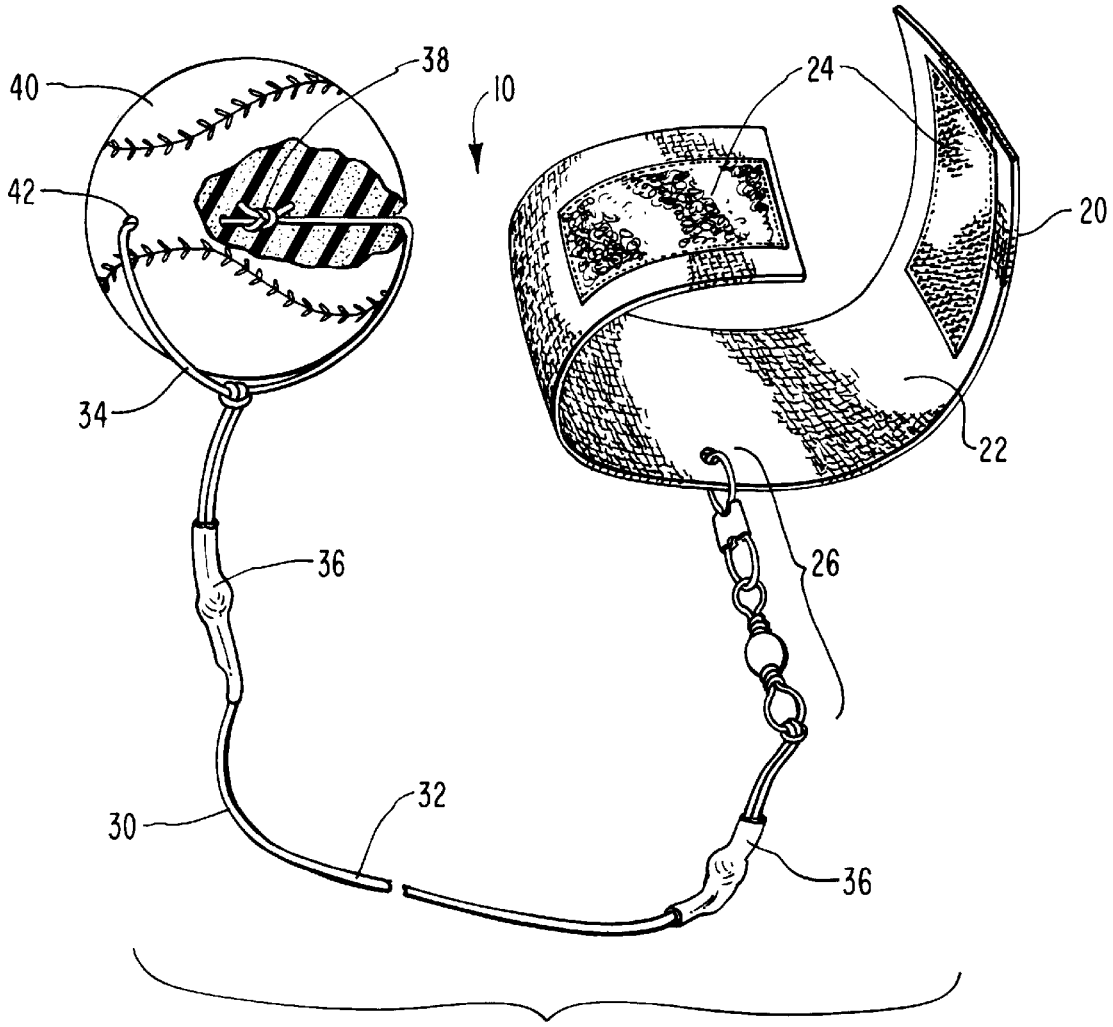
FIG. 1 is a perspective view of one embodiment of the retrievable toy of the present invention.

In the drawings a preferred embodiment 10 of the toy apparatus is shown. Apparatus 10 comprises wrist band 20, elastic member 30 and ball 40.

Wrist band 20 comprises a length of synthetic polyamide webbing 22 to encircle the limb of the user. Means 24 for fastening wrist band 20 may include any conventional fastening means. FIG. 1 illustrates the use of conventional hook and pile fastening means. Hook and pile is preferred because it is adjustable to different size wrists. Snaps, buttons or other adjustment or fastening means may provide equivalent function.

Wrist band 20 also comprises means for avoiding or minimizing the twisting or knotting of the entire length of the elastic cord and ball. The preferred embodiment of the means for avoiding or minimizing the twisting or knotting of the entire length of the elastic cord comprises a freely rotatable swivel 26. Swivel 26 is releasably attachable to webbing 22. In order to optimize the rebound of ball 40 to the hand of the user, swivel 26 is attached to an edge of webbing 22. This provides the user with the advantage of being able to wear wrist band 20 such that swivel 26 is positioned just at the base of the user's palm. Attaching swivel 26 at the edge of webbing 22 also advantageously minimizes any interference of the rotating action of swivel 26 and, hence, of the entire length of elastic member 30.

Figure 2:
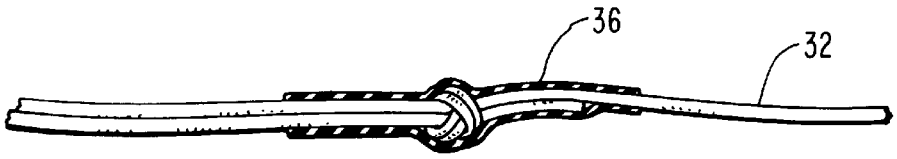
FIG. 2 is a detailed view of a transition length of an elastic band employed by the present invention.

Elastic member 30 comprises two members, elastic rebounding cord member 32 and means 34 for minimizing contact of the elastic cord with the floor or wall. Elastic cord 32 provides the retrieving, rebounding effect needed. Cord 32 is attached directly to swivel 26 at one end and to the means 34 for minimizing contact of the elastic cord with the floor or wall at the other end. To optimize the endurance of cord 32 and to prevent any scratching to the user, sleeve 36 may shroud the knots and ends of cord 32. FIG. 2 shows one embodiment of how sleeve 36 shrouds the knots and ends of cord 32.

Figure 3:
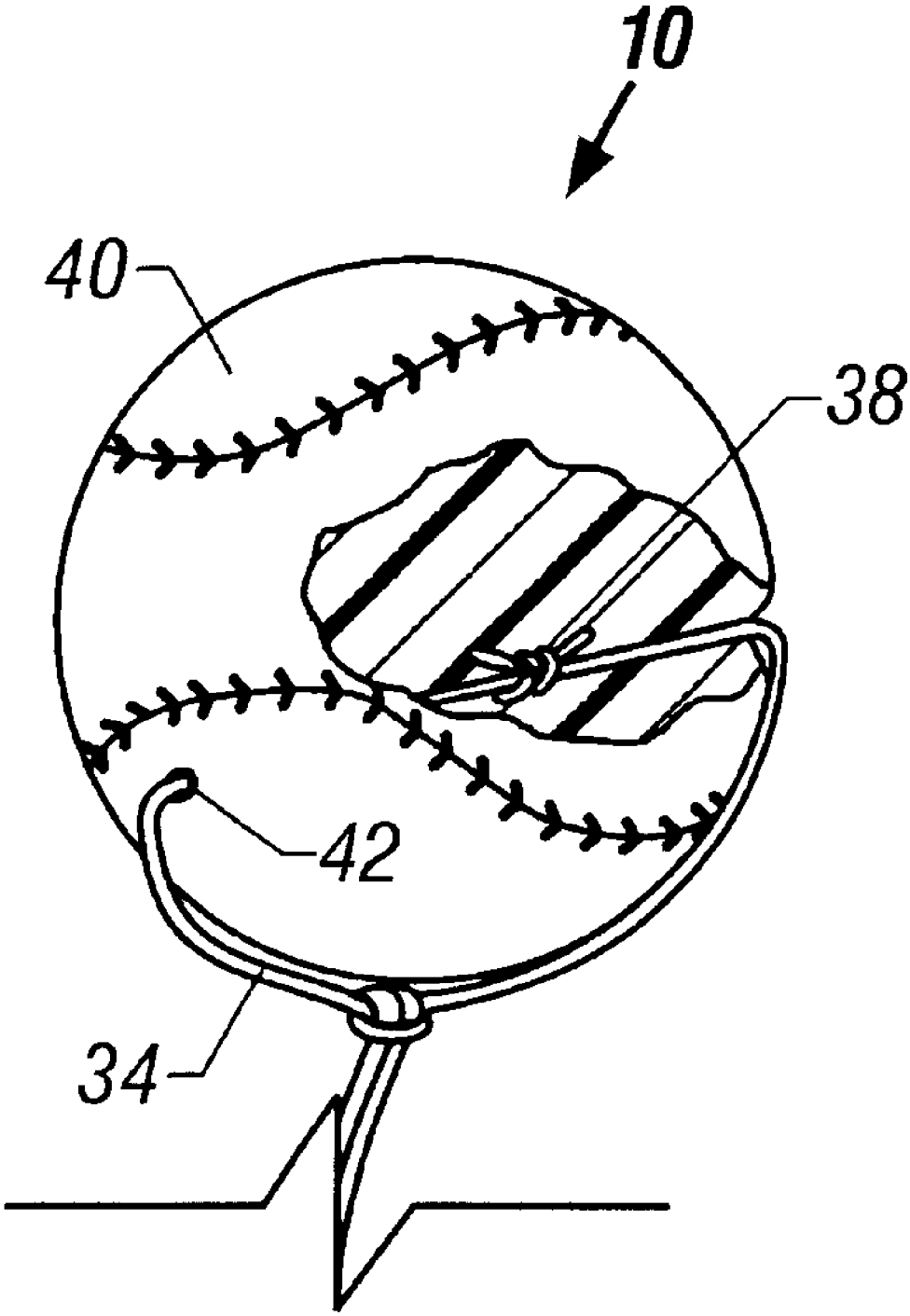
FIG. 3 is a detailed view of the retrievable toy with the cord passing through an off center axis of the ball.

The preferred embodiment of means 34 for minimizing contact of the elastic cord with the floor or wall comprises attachment member 34. Attachment member 34 may be made of the same material as cord 32. However, the preferred embodiment of attachment member 34 comprises a flat elastic construction so that it lies flatter against ball 40. Attachment member 34 is connected to ball 40 by passing a portion of attachment member 34 through a bore 42 inside and to draw knot 38 inside ball 40. It may be preferred to tie a knot in attachment member 34 and to draw known 38 inside ball 40. Bore 42 may pass through an axis of ball 40. However, in the preferred embodiment, bore 42 passes through a portion of ball 40 not along an axis of ball 40 such that a larger continuous surface of ball 40 is free of the attachment member 34, thereby minimizing the contact of attachment member 34 with contact surfaces such as floors and/or wall. This alternative embodiment is shown in FIG. 3. In this way, when thrown, a larger mass of the ball is the leading portion of ball 40 which ultimately contacts a floor or wall thereby minimizing contact of attachment member 34 or cord 32 with a floor or wall.

Ball 40 comprises any ball. Preferably ball 40 comprises a rubber or spongy ball which can be adapted with a bore 42 to receive member 34. For example, ball 40 can be made of a soft material which deforms upon impact to absorb impact energy but which material is sufficiently elastic such that the ball after impact and recoil transforms back to its preimpact shape. Preferably ball 40 is of a weight which when thrown is not significantly hindered by elastic member 30.

It will be appreciated that wrist band 20, elastic member 30 and ball 40 may be manufactured in any color or combination of colors as desired.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus comprising:

a first wrist attachment part, having an adjustable size with an inner surface adapted to press against a user's wrist, and wherein a size of said inner surface can be adjusted to a plurality of different wrist sizes;

a swivel assembly, including a first connection part which is directly connected to said first wrist attachment part, a swivel part connected to said first attachment part at a first end, said swivel part enabling free swiveling, and a second attachment part, connected to another end of said swivel part, to thereby enable free swiveling between said first connection part and said second connection part;

an elastic cord, having first and second ends, said first end connected to said second connection part of said swivel part;

a spherical ball, having a hole therethrough, which extends across an arc defined between outer surfaces defining a circular outer perimeter of the ball; and a connection element which connects said second end of said elastic cord through said hole in said spherical ball.

2. An apparatus as in claim 1 wherein said elastic cord includes first and second parts, and said first part is connected to said second connection part of said swivel assembly, said second part of said elastic cord is connected through said hole, and said connection element includes a knot which connects said first part to said second part.

3. An apparatus as in claim 2 wherein said elastic cord further comprises a third elastic cord part, connected to said connection part of said swivel assembly, and connected by a second knot to another part of said elastic cord.

4. An apparatus as in claim 3 further comprising an elastic sleeve covering said second knot.

5. An apparatus as in claim 3 further comprising a protective sleeve, covering said first knot.

6. An apparatus as in claim 1 further comprising a protective sleeve, covering one of said connection parts.

7. An apparatus as in claim 1 wherein said hole in the ball is a bore through substantially the center of the spherical ball.

8. An apparatus as in claim 1 wherein said hole in the spherical ball extends through an off center axis of the ball.

9. An apparatus as in claim 1 wherein said wrist attachment part includes inner surfaces defining a hole therein, and said first connection part of said swivel is connected directly through said hole in said wrist attachment mechanism.

10. An apparatus as in claim 9 further comprising a hook and pile connection arrangement operable to adjust the size of said wrist attachment mechanism.

11. An apparatus comprising:

a flexible wrist band, having a hook and pile connection arrangement, which enables changing a size of an inner diameter of the wrist band to fit different size wrists, said wrist band including a first hole near an outer peripheral edge thereof;

a swivel assembly connected at said first hole at a first end, and having a second end, and allowing swiveling between said first and second ends;

a first elastic cord connection part, coupled to said second end of said swivel assembly;

an elastic cord, having an elastic property, and connected to said first elastic connection part at a first connection;

a first sleeve, covering the first connection between said first elastic connection part and said elastic cord;

a second elastic connection part, connected to a second end of said elastic cord at a second connection;

a second sleeve, covering the second connection between said second elastic connection part and said second cord end; and a spherical ball, having a bore extending from one side of the ball to another side of the ball, wherein said second elastic connection part is connected through said bore.

12. An apparatus as in claim 11 wherein said bore is through substantially a radial center of the ball.

13. An apparatus as claim 11 wherein said bore is through an off center axis of the ball.

14. An apparatus as in claim 11 wherein said first connection and said second connection include tied knots between the first elastic cord connection part, said elastic cord, and said second elastic cord connection part.

15. A method comprising:

providing a wrist wrap, which is wearable on the wrist of the user, and which has an elastic cord attached thereto, and a substantially spherical ball connected to an opposite end of said elastic cord;

providing a swivel assembly directly connected to the wrist strap, and using said swivel assembly to prevent knots in the elastic cord when the ball is moved back and forth; and connecting an end of the elastic cord through a central bore of the ball to prevent floor contact of the elastic cord.

16. A method as in claim 15 wherein the elastic cord has multiple parts, and further comprising forming connections between the parts, and covering said connections with a protective sleeve.

17. A method as in claim 16 wherein said forming connections comprises forming knots.

* * * * *